United States Patent [19]

Matsuda et al.

[11] Patent Number: 4,654,172

[45] Date of Patent: Mar. 31, 1987

[54] METHOD FOR PROCESSING RADIOACTIVE WASTE RESIN

[75] Inventors: Masami Matsuda, Hitachi; Yoshiyuki Aoyama, Kanagawa; Fumio Kawamura, Hitachi; Hideo Yusa, Katsuta; Makoto Kikuchi; Shin Tamata, both of Hitachi; Susumu Horiuchi, Mito, all of Japan

[73] Assignee: Hitachi, Ltd., Tokyo, Japan

[21] Appl. No.: 613,194

[22] Filed: May 23, 1984

[30] Foreign Application Priority Data

May 30, 1983 [JP] Japan ..... 58-93943

[51] Int. Cl.[4] ..... G21F 9/16; G21F 9/32

[52] U.S. Cl. ..... 252/629; 110/237; 110/342; 110/346; 110/344; 159/DIG. 12; 252/626; 252/632

[58] Field of Search ..... 252/626, 631, 632, 628, 252/629; 159/47.3, DIG. 12; 110/237, 238, 342, 346, 344

[56] References Cited

U.S. PATENT DOCUMENTS

| | | | |
|---|---|---|---|
| 3,954,661 | 5/1976 | Kilian | 252/632 |
| 4,053,432 | 10/1977 | Tiepel et al. | 252/632 |
| 4,152,287 | 5/1979 | Bjorklund et al. | 252/632 |
| 4,235,738 | 11/1980 | Knotik et al. | 252/632 |
| 4,242,220 | 12/1980 | Sato | 252/632 |
| 4,460,500 | 7/1984 | Hultgren | 252/626 |
| 4,499,833 | 2/1985 | Grantham | 252/632 |

FOREIGN PATENT DOCUMENTS

| | | | |
|---|---|---|---|
| 0125381 | 11/1984 | European Pat. Off. | 252/632 |
| 2753368 | 5/1979 | Fed. Rep. of Germany | 252/632 |
| 0094199 | 7/1980 | Japan | 252/632 |
| 0030000 | 2/1982 | Japan | 252/632 |
| 0837967 | 6/1960 | United Kingdom | 252/632 |

*Primary Examiner*—Stephen J. Lechert, Jr.
*Assistant Examiner*—Howard J. Locker
*Attorney, Agent, or Firm*—Beall Law Offices

[57] ABSTRACT

A method of processing radioactive waste resin by pyrolyzing radioactive waste ion exchange resin generated in a nuclear plant such as a nuclear power station. First, the ion exchange resin is pyrolyzed at a low temperature, and the resulting decomposition gas is separated. Second, the ion exchange resin at a high temperature, and the resulting decomposition gas is separated. Finally, the residue of the ion exchange resin is hot-pressed into a molded article.

24 Claims, 13 Drawing Figures

METHOD FOR PROCESSING RADIOACTIVE WASTE RESIN

BACKGROUND OF THE INVENTION

This invention relates to a method and apparatus for processing a used radioactive waste resin (ion exchange resin) generated in a nuclear power station or the like. More particularly, the present invention relates to a method and apparatus for reducing the volume of the waste resin by pyrolysis and for processing the resin into stable inorganic compounds.

A waste liquor containing a variety of radioactive substances is generated in the course of the operation of a nuclear power station or the like, and the waste liquor is mostly processed using ion exchange resins. The processing of the used radioactive waste resins generated in this instance is one of the problems to be solved for the operation of the nuclear power station. In a power station using boiling water reactors, for example, the used ion exchange resin accounts for the major proportions of the radioactive wastes that are generated.

Conventionally, the used ion exchange resin is mixed with a solidifying agent such as cement or asphalt, is then packed into a drum for solidification and is stored in a storage site. Since the quantity of these radioactive wastes is ever-increasing, however, it has become a critical problem how to secure the storage site and to ensure the safety during storage. If the used resin is stored for an extended period of time, it will be decomposed and perish because it is an organic matter. When carrying out the solidification treatment of the used resin, therefore, it is extremely important to reduce the volume of the resin as much as possible (volume reduction) and to convert it into stable inorganic matter (inorganic conversion). An acid decomposition method has been proposed in the past as one of the methods of volume reduction and inorganic conversion of the used resin. This method includes a so-called HEDL process (Hanford Engineering Development Laboratory's process). In this process, the waste resin is decomposed by concentrated sulfuric acid (about 97 wt %) and nitric acid (about 60 wt %) at a temperature of between 150° and 300° C. Another acid decomposition method is disclosed in Japanese Patent Laid-Open No. 88500/1978, according to which the waste resin is decomposed by concentrated sulfuric acid and hydrogen peroxide (about 30%). In accordance with these acid decomposition methods, however, a large number of difficulties are yet to be solved such as handling of a highly acidic liquor, corrosion of an apparatus by the concentrated highly acidic solution, solidification techniques of the concentrated liquor that is recovered, and so forth, although they provide a large volume reduction ratio because they decompose the resin and evaporate and concentrate the resulting decomposition liquor.

As an alternative, Japanese Patent Laid-Open No. 1446/1982 proposes a method which avoids the use of a highly acid solution but decomposes the waste resin using hydrogen peroxide in the presence of an iron catalyst. However, the problems of this method are that the processing cost becomes high because it needs a large quantity of hydrogen peroxide which is rather expensive, and decomposition itself of the waste resin is not sufficient so that the resin is likely to remain as the organic matter.

Japanese Patent Laid-Open No. 12400/1982 discloses still another method of volume reduction and inorganic conversion of the waste resin. In this method, the waste resin is burnt in a fluidized bed. In accordance with this method, however, generation of combustion residue and scattering of radioactive substances are great, exhaust gases generated in large quantities must also be processed and part of the residues after combustion of the used resin is likely to be deposited onto the furnace wall of the fluidized bed. For this reason, the combustion efficiency drops in the course of the use of the fluidized bed for an extended period. In other words, the residue deposited on the furnace wall must be removed periodically and this is extremely trouplesome.

The processing of the residue after the volume reduction and inorganic conversion of the waste resin is the common problem to all of the prior art methods described above. In other words, 1 to 20 wt % of decomposition residue per used resin before processing remains even if any of these methods are used, and this residue must be processed into a suitable form in order to store it in a drum or the like.

SUMMARY OF THE INVENTION

An object of the present invention is therefore to provide a method and apparatus for processing a radioactive waste resin by which the volume of the used radioactive waste resin can be drastically reduced and at the same time the exhaust gas generated during decomposition can be selectively processed.

One of the characterizing features of the present invention resides in a method of processing radioactive waste resin by pyrolyzing radioactive waste ion exchange resin generated in a nuclear plant such as a nuclear power station, which is characterized by pyrolyzing said ion exchange resin at a low temperature, separating the resulting decomposition gas, then pyrolyzing said ion exchange resin at a high temperature, separating the resulting decomposition gas, and thereafter hot-pressing the residue of said ion exchange resin into a molded article.

The other characterizing feature of the present invention resides in an apparatus for processing radioactive waste resin by pyrolyzing radioactive waste ion exchange resin generated in a nuclear plant, which apparatus comprises a reaction vessel for pyrolyzing the ion exchange resin, a heating means for heating the reaction vessel to low and high temperatures, a feed means for feeding the radioactive ion exchange resin into the reaction vessel, a low-temperature decomposition gas separation means for separating the decomposition gas generated within the reaction vessel during the pyrolysis at a low temperature, a high-temperature decomposition gas separation means for separating the decomposition gas generated within the reaction vessel during the pyrolysis at a high temperature, and a hot press means for hot-pressing the residue of the ion exchange resin remaining within the reaction vessel after the pyrolysis at a high temperature.

These and other objects and advantages of the present invention will become more apparent by referring to the following detailed description and accompaning drawings, in which:

BRIEF DESCRIPTION OF THE DRAWINGS

FIGS. 10 through 12 show one embodiment of the apparatus of the present invention, in which: FIG. 10 is a system diagram of the apparatus; FIG. 11 is a perspective view showing part of the reaction apparatus; and FIG. 12 is a schematic longitudinal sectional view of the apparatus.

DESCRIPTION OF THE PREFERRED EMBODIMENT

Figure 1:
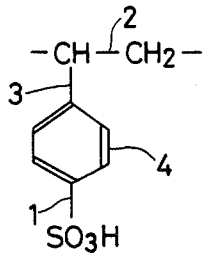
FIG. 1 shows a skeleton of an ion exchange resin.

Now, the fundamental principle of the present invention will be described.

Methods of reducing the volume of a used ion exchange resin and converting it into inorganic matter include a wet process represented by acid decomposition and a dry process represented by a fluidized bed.

The wet process involves the problem that the radioactive waste liquor containing a decomposition residue must be reprocessed by evaporation concentration or the like after the used resin is decomposed. The dry process is more advantageous than the wet process in that it is free from such aproblem, but the following problems occur in the fluidized bed process as a typical example of the dry process.

(1 ) Large quantities of the residue and radioactive substances are spattered. In other words, since the used resin is decomposed and burnt under the fluidized gas, the residue and the radioactive substances are entrained and spattered by the exhaust gas. For this reason, the load to a filter for processing the exhaust gas becomes great.

(2) Detrimental gases such as SOx or NOx are generated when the used resin is burnt, and the processing of the exhaust gas with an alkaline scrubber or the like becomes necessary, but the quantity of exhaust gas to be processed is enormous. In the fluidized bed process, air containing $O_2$ 3 to 5 times the chemical equivalent must be supplied and hence the exhaust gas quantity becomes great.

(3) The radioactive waste after the volume reduction and inorganic conversion contains not only the residue but also $Na_2SO_4$ and the like generated during the processing of the exhaust gas ($SOx+NaOH \rightarrow Na_2SO_4+H_2O$). Accordingly, when 1 kg of the used resin is processed, the radioactive waste after the processing amounts to about 0.7 kg so that the volume reduction ratio is small.

(4) Since the combustion is effected at a temperature of between 600° and 900° C., part of the residue is fused and deposited onto the furnace wall of the fluidized bed. If the fluidized bed is used for an extended period, the decomposition ratio will drop.

(5) The non-fused radioactive residue that is withdrawn outside the furnace has a fine particle size (1 to 100 μm), so that its handling is difficult. In order to solve these problems with the conventional fluidized bed process, the present invention provides a novel dry process which has the following constitutions to process the used ion exchange resin:

(a) In order to prevent the residue and the radioactive substances from being spattered, the used ion exchange resin is pyrolyzed while it is kept in a stationary or like state.

(b) The pyrolysis is effected at a low temperature (120°-350° C.) and then at a high temperature (350° C. or above).

(c) The residue after the pyrolysis is hot-pressed.

Generally, an ion exchange resin is an aromatic organic high-molecular compound based on a copolymer of styrene and divinylbenzene (D.V.B.) and containing a sulfonic acid group bonded thereto in the case of a cation ion exchange resin and a quanternary ammonium group bonded thereto in the case of an anion exchange resin. In these resins, the bond energy between the ion exchange group (the sulfonic acid or quaternary ammonium group) and the resin main body is much weaker than that of the resin main body itself i.e. the copolymer between styrene and D.V.B. The present inventors have paid a special attention to this fact. When pyrolysis of the ion exchange resin is effected at a low temperature as a first-stage procedure, only the ion exchange group can be selectively decomposed. After the decomposition gas generated by this pyrolysis is separated, the remaining resin is pyrolyzed at a high temperature so as to decompose the resin main body and the resulting decomposition gas is separated. In this manner, nitrogen oxide gases (NOx) and sulfur oxide gases (SOx) that would otherwise need an elaborate exhaust gas treatment can be generated only in the first-stage low-temperature pyrolysis, while hydrogen gas ($H_2$), carbon monoxide gas (CO) and carbon dioxide gas ($CO_2$) that scarcely need the exhaust gas treatment can be generated selectively in the subsequent high-temperature pyrolysis. Accordingly, the quantity of the exhaust gases that must be processed can be drastically reduced, and the residue can be converted into stable inorganic compounds.

In the present invention, when the ion exchange group is decomposed by the low-temperature pyrolysis, the feed of oxygen is not necessary so that the low-temperature pyrolysis can be effected in a stationary gas, thereby making it possible to prevent spattering of the residue and the radioactive waste. Since the secondary waste such as $Na_2SO_4$ that is generated as a result of the exhaust gas treatment of NOx and SOx can be thus made nonradioactive, the radioactive waste is limited to only the residue after the high-temperature pyrolysis and the quantity of the radioactive waste after the pyrolysis can be drastically reduced to about 1/20. During the high-temperature pyrolysis for which the feed of oxygen is necessary, the velocity of the oxygen gas or air within the reaction vessel can be reduced to such an extent that the used resin does not spatter, and the spattering of the residue and the radioactive substances can be minimized. Thus, the load to a filter for treating the exhaust gas can also be reduced markedly.

The present inventors have noted also the fact that the residue after the high-temperature pyrolysis is partly fused. Accordingly, in the present invention, this residue is hot-pressed into an easy-to-handle molded article, and the volume of the radioactive waste is reduced to about 1/30 of the original volume.

Now, preferred embodiments of the present invention will be described in detail with reference to the accompanying drawings.

The cation exchange resin has a cross-linked structure with a polymer backbone based on a copolymer consisting of styrene

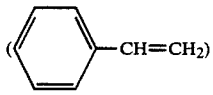

and divinylbenzene

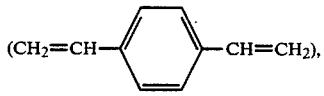

to which is bonded a sulfonic acid group ($SO_2H$) as the ion exchange group. It has a three-dimensional structure which is expressed by the following structural formula:

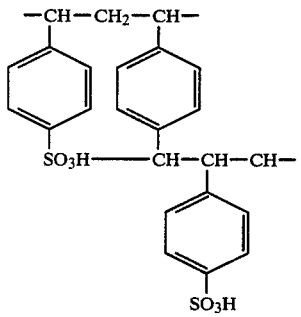

Its molecular formula is $(C_{16}H_{15}O_3S)_n$.

On the other hand, the anion exchange resin has a structure with a polymer backbone based on the same copolymer as that of the cation exchange resin, to which is bonded a quaternary ammonium group ($NR_3OH$) as the ion exchange group, and is expressed by the following structural formula:

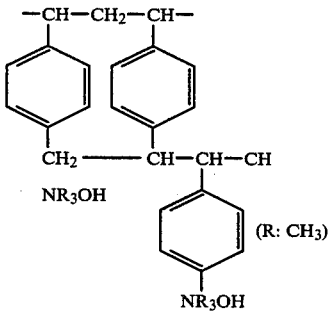

Its molecular formula is expressed by $(C_{20}H_{26}ON)_n$.

Next, the bond energy at a bond portion between respective components of the ion exchange resin will be described. FIG. 1 shows the skeletal structure of the cation exchange resin, though that of the anion exchange resin is fundamentally the same except that the ion exchange group is different. The bond energy at each bond portion 1, 2, 3, and 4 between the respective components shown in FIG. 1 is listed in Table 1.

TABLE 1

| Bond portion | | Structure | Bond energy (kJ/mol) |
|---|---|---|---|
| 1 | ion exchange group | quaternary ammonium group (anion resin) | 246 |
| | | sulfonic acid group (cation resin) | 260 |
| 2, 3 | polymer backbone | straight-chain portion | 330–370 |
| 4 | | benzene ring portion | 480 |

Figure 2:
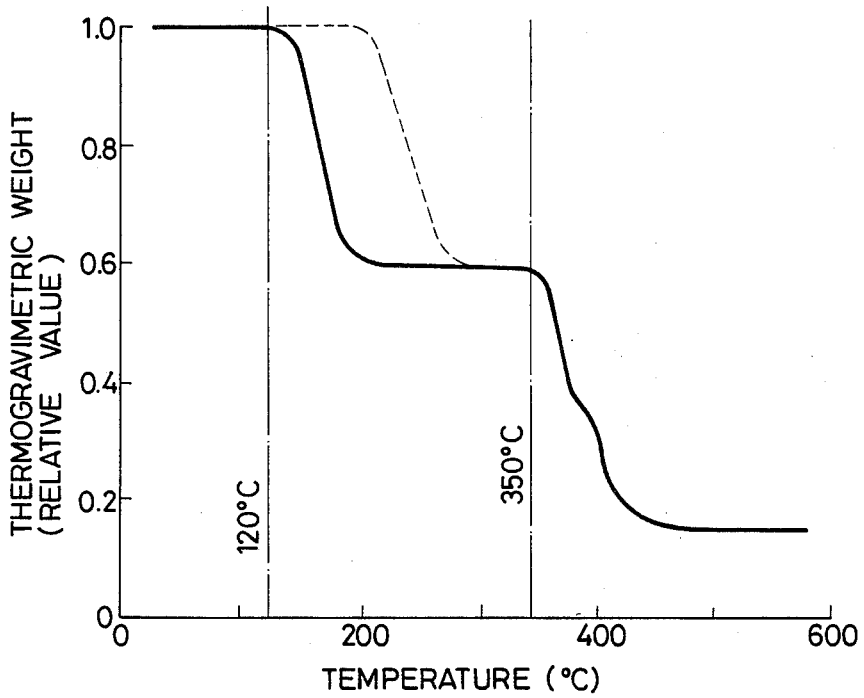
FIG. 2 is a diagram showing the result of the thermogravimetric analysis of the ion exchange resin.

When the ion exchange resin is pyrolyzed, the ion exchange group having the smallest bond energy is first decomposed, then the straight-chain portion of the polymer backbone is decomposed and finally the benzene ring portion is decomposed. FIG. 2 shows the result of a thermogravimetric analysis (TGA) of the ion exchange resin using a differential thermal balance. However, the weight reduction resulting from the evaporation of water occurring at 70° to 110° C. is not illustrated. The solid line represents changes in the thermogravimetric weight of the anion exchange resin and the broken line that of the cation exchange resin. The decomposition temperature at each bond portion shown in FIG. 2 is listed Table 2.

TABLE 2

| Structure | Decomposition temperature (°C.) |
|---|---|
| ion exchange group | |
| quaternary ammonium group (anion resin) | 130–190 |
| sulfonic acid group (cation resin) | 200–300 |
| polymer backbone | |
| straight-chain portion | 350–400 |
| benzene ring portion | 380–480 |

It can be understood from Table 2 that the quaternary ammonium group as the ion exchange group is first decomposed at 130°–190° C., then the straight-chain portion at 350° C. or above and finally the benzene ring portion at 380° C. or above in the anion exchange resin. In the cation exchange resin, on the other hand, the sulfonic acid group as the ion exchange group is first decomposed at 200°–300° C., then the straight-chain portion, and finally the benzene ring portion in the same way as in the anion exchange resin.

In view of the result described above, only the ion exchange group of the ion exchange resin is first decomposed selectively in the first stage at a temperature of between 120° and 350° C., preferably about 300° C., so that nitrogen and sulfur contained in only the ion exchange group are converted into nitrogen compounds (NOx, $NH_3$, etc) and sulfur compounds (SOx, $H_2S$, etc) in this stage. Incidentally, a temperature of 120° C. is a withstand temperature of the ion exchange resin, and the ion exchange group can be decomposed when being heated to at least this temperature. The temperature of 300° C. is the point at which both the cation and anion exchange groups can be completely decomposed but the resin main body is not decomposed.

Thereafter, the high-temperature pyrolysis is effected in the second stage at a temperature above 350° C. Since the polymer backbone consisting of carbon and hydrogen is completely decomposed, the residue becomes below several percents. The exhaust gas generated at this time consists of CO, $CO_2$, $H_2$ and the like, so that no particular exhaust gas processing is necessary.

Since the low-temperature and the high-temperature pyrolysis are carried out in multiple stages so as to decompose the ion exchange resin, the exhaust gas processing becomes by far easier than in the pyrolysis which is carried out in a single stage at a high temperature of above 350° C. In other words, when the high-temperature pyrolysis is effected as the single stage treatment, 1.42 $m^3$ of exhaust gas is generated per kg of ion exchange resin (a 2:1 mixture of an anion exchange resin and a cation exchange resin), and only about 5% of sulfur oxides and nitrogen oxides (0.074 $m^3$ in total) are contained in the gas. If the pyrolysis is effected in two stages, on the other hand, the low-temperature pyrolysis is carried out below 350° C. and then the high-temperature pyrolysis above 350° C., so that 0.074 $m^3$ of the sulfur oxides and nitrogen oxides are generated only in the low-temperature pyrolysis of the first stage, but they are not generated in the high-temperature pyrolysis of the second stage and 1.34 $m^3$ of $CO_2$ and the like is generated. Since emission of the exhaust gas into the air is legally regulated, the exhaust gas processing such as desulfurization or denitrification is necessary for the sulfur oxides and nitrogen oxides. Since they are generated only in a limited quantity during the low-temperature pyrolysis of the first stage, however, the quantity of the exhaust gas to be processed is only 0.074 $m^3$.

On the other hand, if the pyrolysis is effected as the single-stage treatment, great quantities of other exhaust gases must be altogether processed in order to process the sulfur and nitrogen oxides that are contained in a quantity of as small as only 0.074 $m^3$ (5%), and the exhaust gases of as much as 1.42 m: must be processed. Accordingly, exhaust gas processing equipment must inevitably have a large scale. If the pyrolysis is carried out in two stages in accordance with the present invention, the quantity of the exhaust gases that must be carefully processed can be reduced to about 1/20.

As described above, it has been found that if the ion exchange resin is pyrolyzed in two stages, the quantity of the exhaust gas that requires careful processing can be drastically reduced. In accordance with the fluidized bed process, the air containing oxygen two to five times the chemical equivalent must be supplied in order to fluidize the used resin, and hence the quantity of the exhaust gas that must be processed becomes enormous. In the present invention, on the other hand, the air to be supplied during the pyrolysis is extremely limited. This will be explained on the basis of the experimental results.

Figure 3:
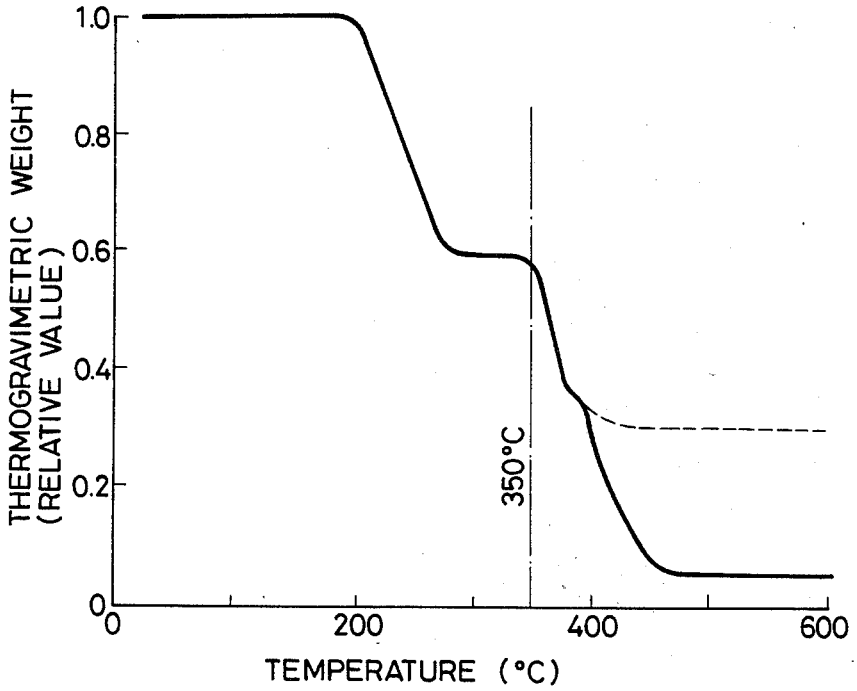
FIG. 3 is a diagram showing the result of thermogravimetric analysis of a cation exchange resin.
Figure 4:
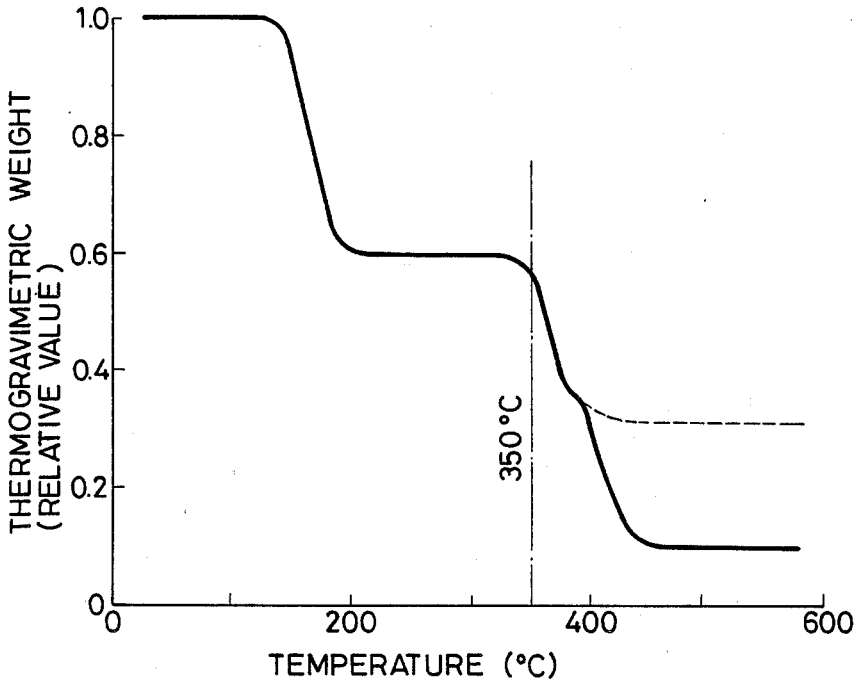
FIG. 4 is a diagram showing the result of thermogravimetric analysis of an anion exchange resin.

The experimental results shown in FIGS. 3 and 4 pertain to the data when thermogravimetric analyses were carried out in an atmosphere of air containing oxygen in the chemical equivalent necessary for the pyrolysis of the used resin and in a nitrogen atmosphere not containing oxygen, respectively. Incidentally, the thermogravimetric analysis shown in FIG. 2 represents the data when oxygen in an amount sufficiently greater than the chemical equivalent was supplied. FIG. 3 represents the data when the cation exchange resin was pyrolyzed. The solid line represents the analysis effected in an atmosphere in which oxygen was present in the chemical equivalent, and the broken line represents the analysis effected in a nitrogen atmosphere. As shown in the diagram, the thermogravimetric characteristics similar to those when large quantities of oxygen was supplied could be observed if oxygen was present in an amount corresponding to the chemical equivalent, and the residue after the high-temperature pyrolysis could be reduced to below several percents. In the nitrogen atmosphere, too, the ion exchange group (sulfonic acid group) was pyrolyzed at 200° to 300° C. It was thus found that the feed of oxygen was not necessary for the pyrolysis of the ion exchange group.

FIG. 4 shows the data when the anion exchange resin was pyrolyzed. In the same way as in FIG. 3, the solid line represents the atmosphere in which oxygen was present in an amount corresponding to the chemical equivalent, and the broken line represents the nitrogen atmosphere. It was found that in the pyrolysis of the anion exchange resin, too, the ion exchange group (quaternary ammonium group) could be decomposed at 130° to 190° C. even if no oxygen was present, and the polymer backbone could be decomposed at 350 to 480° C. in the presence of oxygen in an amount corresponding to the chemical equivalent.

It was found that oxygen need not be supplied in the low-temperature pyrolysis, and oxygen in an amount equal to, or greater than, the chemical equivalent need be supplied in the high-temperature pyrolysis. Thus, it can be understood that, in accordance with the present invention, the quantity of the exhaust gas to be processed can be reduced drastically.

In accordance with the present invention, the spattering of the residue of the pyrolysis and the radioactive substances can be drastically reduced in comparison with the conventional fluidized bed process. Since the used resin is fluidized together with the gas in the fluidized bed process, the residue and the radioactive substances are entrained by the exhaust gas, resulting in the enhanced spattering. In accordance with the pyrolysis process, on the other hand, the spattering can be markedly reduced because the used resin can be calmly decomposed without causing its fluidization. This will be described with reference to FIGS. 5 through 7.

Figure 5:
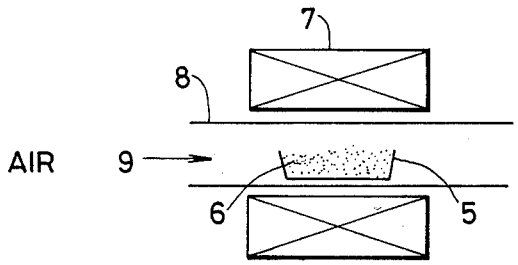
FIG. 5 is a schematic view of an apparatus for the basic experiment of pyrolysis.
Figure 6:
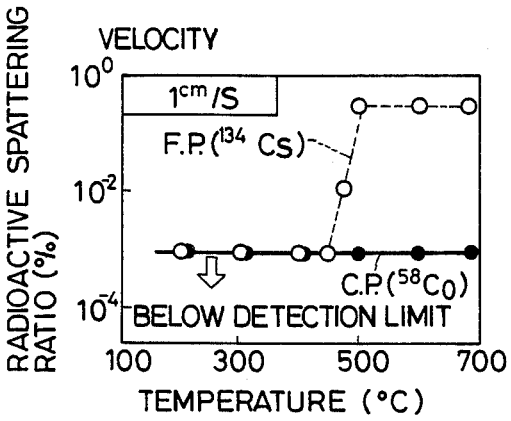
FIG. 6 is a diagram showing the temperature dependence of a radioactive spattering ratio.

FIG. 5 illustrates an apparatus used for the experiment. About 10 g of an ion exchange resin 6 containing about 100 $\mu$Ci of adsorbed radioactive substances ($^{58}Co$, etc) was packed into a glass boat 5, and was thermally decomposed within a quartz tube 8. A tubular furnace 7 was used for the pyrolysis. Air 9 was supplied at a constant velocity from one of the ends of the quartz tube 8, and the quantities of the radioactive substances spattering towards the exhaust side and the amount of the residue were measured. FIG. 6 shows an example of changes in the spattering ratio of the radioactive substances when the pyrolysis temperature was changed. In the diagram, symbol C.P. and F.P. refer to a corrosive product and a nuclear fission product, respectively. The spattering ratio of $^{58}Co$ represented by the solid line was below $10^{-3}$% (detection limit) in the entire temperature range, while the spattering ratio of $^{134}Cs$ represented by the broken line was below $10^{-3}$% below 470° C. and 0.2% above 470° C. The spattering ratio of the residue was below $10^{-3}$% in the entire temperature range for both $^{58}Co$ and $^{134}Cs$. The reason why $^{134}Cs$ spattered at a temperature above 470° C. was that $^{134}Cs$ adsorbed by the ion exchange group was oxidized by oxygen in the air into $Cs_2O$ (m.p. 490° C.) and this compound evaporated. To confirm this, the spattering ratios of other radioactive substances were also examined. As a result, it was found that the spattering started with temperatures above the melting points of their oxides.

Figure 7:
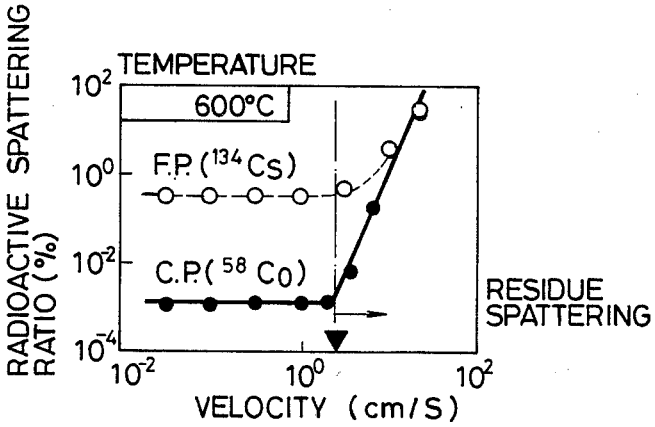
FIG. 7 is a diagram showing the velocity dependence of the radioactive spattering ratio.

When the velocity of the air to be supplied into the quartz tube 8 was changed, the result shown in FIG. 7 could be obtained. In other words, the radioactive spattering ratio increased drastically at a velocity of above 1.5 cm/s, and it was in agreement with the spattering ratio of the residue. At a velocity below 1.5 cm/s, on the other hand, the spattering ratio of the residue was below $10^{-3}$% in all cases, and the radioactive spattering ratio was also small.

TABLE 3

| Radioactive nuclide | | Melting point of oxide (°C.) | Radioactive spattering initiating temperature (°C.) |
|---|---|---|---|
| Corrosive product (C.P.) | $^{58}Co$ | 1800 | >1000 |
| | $^{54}Mn$ | 1650 | |
| | $^{59}Fe$ | 1370 | |
| | $^{51}Cr$ | 1550 | |
| Nuclear fission product (F.P.) | $^{134}Cs$ | 490 | 470 |
| | $^{83}Rb$ | 400 | 420 |
| | $^{90}Sr$ | 2400 | >1000 |
| | $^{140}La$ | 2000 | |

The results shown in FIG. 7 and Table 3 can be summarized as follows.

(1) To reduce the quantities of the spattering residue and radioactive substances, the pyrolysis is preferably effected at a velocity of below 1.5 cm/s.

(2) If the pyrolysis is effected at a velocity of below 1.5 cm/s, the spattering ratios of the radioactive substances are as follows:

(i) below $10^{-3}$% in all cases for corrosive products such as $^{58}Co$ or $^{54}Mn$. (Generally, the radioactive substance contained in the used resin generated in a nuclear power station is only the corrosive product.)

(ii) $10^{-3}$% of nuclear fission products such as $^{134}CS$ below 400° C. and about 0.2% above 400° C. (The nuclear fission products are contained in the used resin only when the breakage of fuel rods occurs.)

When pyrolyzing the used resin, only the ion exchange group is selectively separated in the low-temperature pyrolysis (below 350° C.) not requiring the feed of oxygen or the like, and the detrimental gas such as SOx is removed. Then, the polymer backbone is pyrolyzed in the high-temperature pyrolysis (above 350° C.) while supplying oxygen in an amount at least equal to the chemical equivalent. In this manner, since no oxygen is supplied from outside during the low-temperature pyrolysis, the radioactivity of the exhaust gas such as SOx is extremely limited (radioactive spattering ratio $<10^{-3}$%), and the secondary waste generated as a result of the treatment of the exhaust gas such as SOx or NOx by an alkali scrubber or the like, such as $Na_2SO_4$ ($SOx+NaOH \rightarrow Na_2SO_4+H_2O$) and $NaNO_3$ ($NOx+NaOH \rightarrow NaNO_3+H_2O$), becomes non-radioactive. As a result, the radioactive waste is limited to only the residue. When 1 kg of the used resin (a 2:1 mixture of the cation exchange resin and the anion exchange resin) was processed, the radioactive spattering ratio was as high as from 10 to 20% in accordance with the conventional fluidized bed process, so that about 0.65 kg of the secondary waste such as $Na_2SO_4$ and about 0.05 kg of the residue become the radioactive waste. In accordance with the present invention, on the other hand, only about 0.05 kg of the residue becomes the radioactive waste, so that the quantity of the radioactive waste can be drastically reduced. If the present invention is employed, the weight of the radioactive waste remaining after the inorganic conversion and volume reduction treatment of the used resin can be thus reduced to below 1/10 of the weight of the waste in accordance with the conventional fluidized bed process.

Furthermore, since the velocity of the air supplied from outside during the high-temperature pyrolysis (above 350° C.) is limited to below 1.5 cm/s in terms of the mean velocity within the reaction vessel in the present invention, the spattering of the residue as well as of the radioactive substances can be reduced remarkably ($10^{-3} \sim 0.2$%). In comparison with the fluidized bed process in which the spattering ratio of the residue and radioactive substances is from 10 to 20%, the load to a filter for the exhaust gas can also be reduced remarkably. Incidentally, in the experiment shown in FIG. 5, a powdery ion exchange resin having an average particle size of 10 μm was used as the ion exchange resin, though an about 20:1 mixture (volume ratio) of this resin and a granular ion exchange resin having an average particle size of 500 μm is generally used in a nuclear power station. When only the granular ion exchange resin is processed, the spattering of the residue and radioactive substances does not occur if the average velocity of oxygen to be supplied is below 10 cm/s. In other words, in order to reduce the load to the filter for the exhaust gas, the air or oxygen must be supplied at such a level at which no spattering of the residue and radioactive substances will occur.

As described above, if the used resin is pyrolyzed in two stages of the low-temperature and the high-temperature pyrolysis, the quantity of the exhaust gas that requires careful exhaust gas processing can be reduced to 1/20 and the weight of the radioactive waste can also be reduced to 1/10. Furthermore, the load to the filter for the exhaust gas can be reduced remarkably.

The embodiments of the present invention, in which the two-stage pyrolysis method having the excellent features as described above is further developed, will now be described.

Since the high-temperature pyrolysis is effected at 350° C. or above, preferably from 500° to 600° C., part of the residue within the reaction vessel is in a fused state. For this reason, the residue sticks to the inner wall of the reaction vessel and cannot be easily withdrawn from the vessel. Accordingly, the reaction vessel can be used only 3 to ten times. The residue that can be withdrawn from the reaction vessel without sticking thereto is fine powder having a particle size of 1 to 100 μm, and hence it is easy to spatter and its handling is not easy. The problem that part of the residue attaches to the reaction vessel is also observed in the conventional fluidized bed process, but in such a case, most of the residue is present in the fluidized gas so that the amount of deposition is as small as below 0.1% (5 to 10% in the two-stage pyrolysis method), and the vessel can be used repeatedly 50 to 200 times. (In the fluidized bed process, too, the heat transfer efficiency drops with the increase in the amount of deposition to thereby reduce the decomposition ratio of the used resin, and handling of the withdrawn residue is difficult, in the same way as in the two-stage pyrolysis method.)

Figure 8:
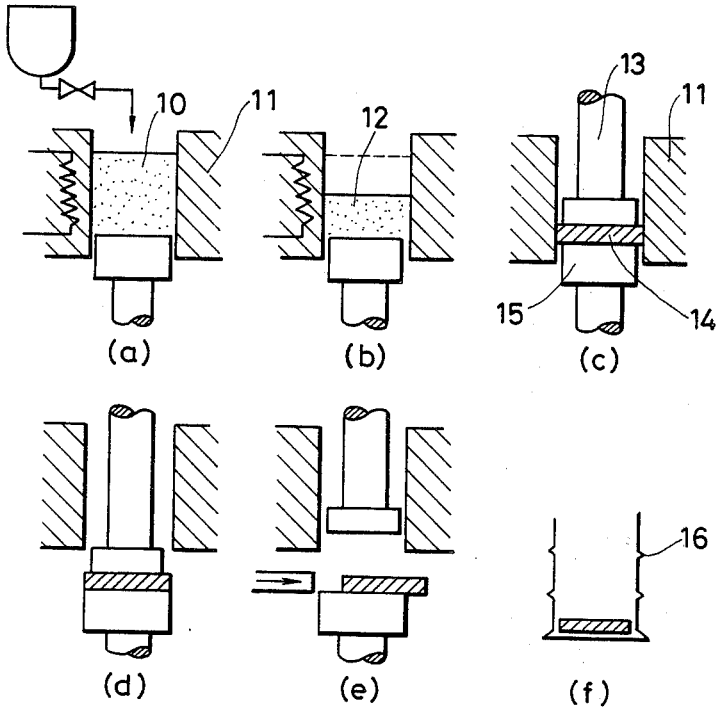
FIG. 8 is a schematic process view showing an example of the method of the present invention.

In order to solve the problems with the two-stage pyrolysis method described above, in the embodiments of the present invention, the residue is hot-pressed within the reaction vessel before it is withdrawn from the reaction vessel after the pyrolysis. One of such embodiments will be described in detail with reference to FIG. 8. The used resin 10 is placed in the reaction vessel 11 (FIG. 8(*a*)) and is then subjected to the volume reduction and inorganic conversion treatment (8(*b*)). The residue 12 generated in this case is hot-pressed as such while kept at the temperature of the high-temperature pyrolysis into a molded article 14 (8(*c*)). In this case, part of the residue 12 is in a fused state, so that it serves as a binder and a firm molded article 14 can be formed. Moreover, since the residue is at a high temperature, the pressure necessary for hot pressing is only about 1/10 of that effected at room temperature.

Thereafter, the molded article 14 is withdrawn from the reaction vessel 11 (8(*d*) and 8(*e*)), and is stored in a waste storage vessel such as a drum 16 (8(*f*)). When hot-pressing the residue and withdrawing the molded article 14, upper and lower pistons 13 and 15 slide on the inner wall surface of the reaction vessel 11, so that any residue adherent to the inner wall surface of the reaction vessel can be completely removed, and build-up of the residue on the reaction vessel can be prevented.

As an example, when 100 g of the used resin was packed in a cylindrical reaction vessel having an inner diameter of 40 mm and a depth of 200 mm and the resin was thermally decomposed at a high temperature of 600° C., about 6 g of residue was left, and when this residue was hot-pressed at 600° C. and a pressure of 50 kg/cm$^2$ within the reaction vessel, there could be obtained a disc-like molded article having a volume of 6 cm$^3$ and a density of 1 g/cm$^3$. It was confirmed that the compression strength of this molded article became at least 150 kg/cm$^2$ after cooling. For the sake of comparison, when about 6 g of residue was cooled and was then cold-pressed at a temperature of 20° C. and a pressure of 500 kg/cm$^2$ (the residue could not be cold-pressed at a pressure of 50 kg/cm$^2$), there could be obtained a molded article having a density of 0.9 g/cm$^3$, but its compression strength was as small as 10 kg/cm$^2$. This suggests that, even if the two-stage pyrolysis is effected, the residue contains considerable organic matters and if the residue is hot-pressed under the high temperature condition where the residue is softened as a whole, molding can be effected under a pressure by far lower than that required for cold-press and moreover, part of the residue that is in a fused state functions as a binder in the case of hot-press, so that a molded article having by far higher strength can be obtained by hot-press than by cold-press.

Figure 9:
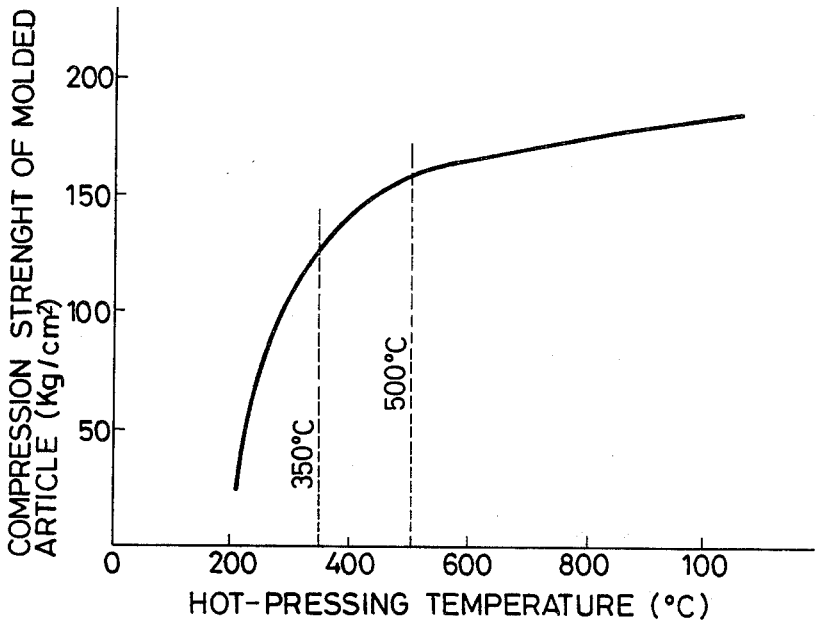
FIG. 9 is a diagram showing the optimum processing condition of hot-press.

FIG. 9 shows the compression strength of the molded article after cooling when hot-press was effected under a pressure of 50 kg/cm$^2$ while changing the hot-pressing temperatures. When hot-pressed at a temperature above 500° C., the molded article exhibited a compression strength of at least 150 kg/cm$^2$. When hot-pressed at a temperature below 350° C., the molded article exhibited the compression strength below 100 kg/cm$^2$. It was thus found that the strength of the molded article was low.

Even when the apparatus of the invention described above was used repeatedly 100 times, no deposition nor build-up of the residue on the reaction vessel could be observed, and the drop of the decomposition ratio due to the use of the apparatus for an extended period could be prevented.

As described above, when the residue after the two-stage pyrolysis is hot-pressed within the reaction vessel, the following effects can be obtained.

(1) Deposition and build-up of the residue on the reaction vessel can be completely prevented and the apparatus can be used repeatedly more than 100 times. The heat transfer characteristics do not deteriorate during the use and the decomposition ratio of the used resin does not drop, either.

(2) The molded article withdrawn from the reaction vessel is strong and does not get powdered. Accordingly, the residue can be handled extremely easily.

(3) In accordance with the conventional fluidized bed process, the withdrawn residue is fine powder and is highly likely to spatter. Moreover, the bulk density of the residue is low (0.1–0.2 g/cm$^3$). For this reason, the volume reduction effect is small and post-treatment such as pelletization or plastic solidification is necessary. In the embodiments of the present invention, on the other hand, the residue is hot-pressed under a pressure of about 50 kg/cm$^2$ so that the molded article has a density of from 0.95 to 1.05 g/cm$^3$. This value is extremely close to the true specific density of the residue of 1.1 g/cm$^3$. Accordingly, the volume reduction effect is high and no post-treatment of the residue is necessary.

In the embodiment described above, the hot-pressing temperature is the temperature of the high-temperature pyrolysis (ordinarily, from 500° to 600° C.), but hot-press may be effected at a higher temperature (about 800° C.). In such a case, the proportion of the fused resin increases, so that the hot-pressing pressure can be reduced and the strength of the resulting molded article can be improved.

The characterizing features of the embodiment described above can be summarized as follows.

(1) The used resin is pyrolyzed in the two-stage pyrolysis consisting of the low-temperature and the high-temperature pyrolysis, and the residue after the pyrolysis is hot-pressed.

(2) The pyrolysis and hot-press are carried out within the same reaction vessel.

(3) In the low-temperature pyrolysis, the pyrolysis is conducted without feeding a gas such as oxygen at a temperature below 350° C., while the high-temperature pyrolysis is conducted at above 350° C. while feeding the air or oxygen gas.

(4) Hot-press is effected in a stage in which part or the whole of the residue is fused or softened.

Now, examples of the practical apparatus for embodying the method of the present invention described above will be described with reference to FIGS. 10 through 13.

EXAMPLE 1

Figure 10:
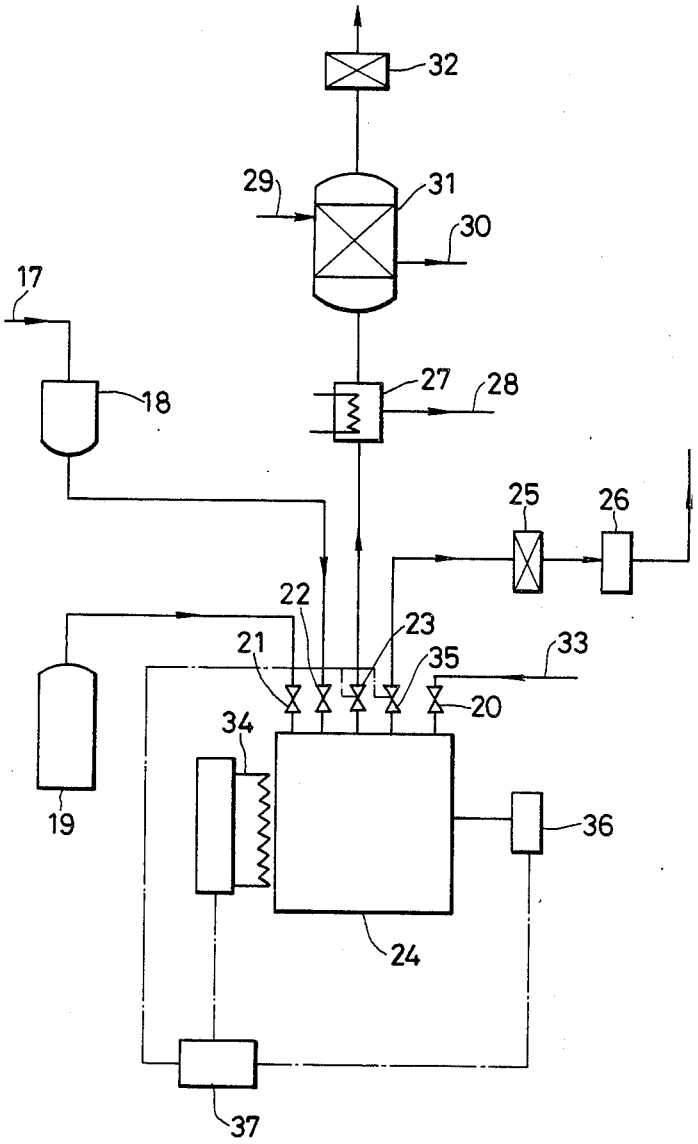
Figure 11:
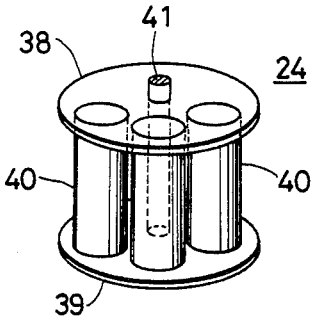
Figure 12:
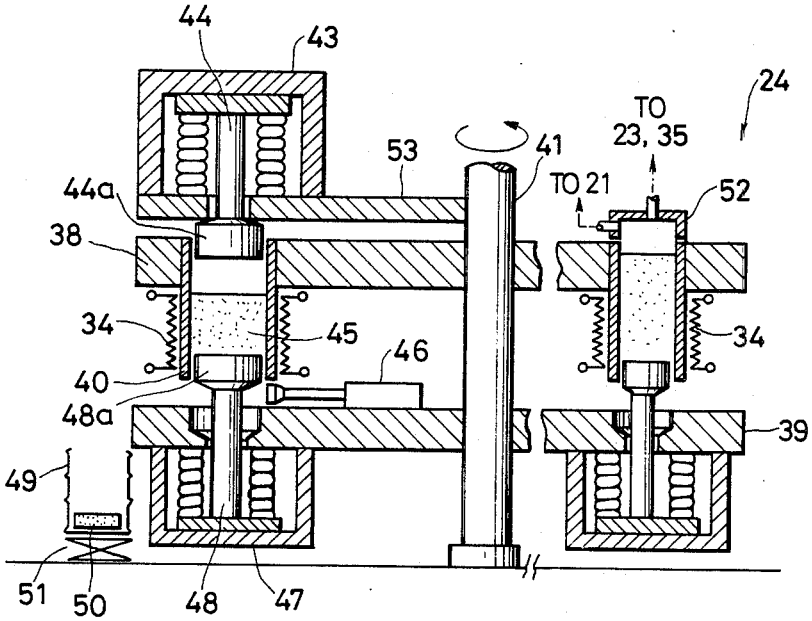

The apparatus shown in FIGS. 10 through 12 was used in the volume reduction and inorganic conversion of an ion exchange resin generated from a condensate purifier of a boiling water reactor by means of pyrolysis. FIG. 10 is a diagram showing the construction of the system, FIG. 11 is a prespective view of part of the reaction apparatus, and FIG. 12 is a schematic sectional view of the apparatus. The waste resin took a slurry form because it was discarded from a condensate desalting device by back wash. The waste resin slurry containing corrosive products such as $^{60}$Co or $^{54}$Mn as the radioactive substances was supplied from a slurry transportation pipe 17 to a slurry tank 18. A predetermined quantity of the waste resin within the slurry tank 18 was supplied to a reaction vessel 40 provided in the reaction apparatus 24 through a valve 22. A plurality (ten in this example) of reaction vessels 40 were disposed on a turn table 38 in the disc arrangement as shown in FIG. 11, and each reaction vessel had an inner volume of 300 l and a diameter of 550 mmϕ.

The waste resin containing adsorbed corrosive products such as $^{60}Co$ in an amount of $10^{-2}$ μCi/g (on a dry basis) was supplied to each reaction vessel 40 in an amount of 10 kg (100 kg in total). After the resin was supplied, a lid 52 leading to an exhaust gas processing system was placed, and the waste resin supplied into each reaction vessel 40 was heated to 350° C. by a heater 34 for pyrolysis without feeding oxygen or the like as an oxidizing agent. As a result, only the ion exchange group of the waste resin was pyrolyzed, producing about 10 $m^3$ of sulfur and nitrogen compounds (SOs, $H_2S$, NOx, $NH_3$, etc) in the gas form. These gases were introduced into the exhaust gas processing apparatus through the valve 23, were removed in an alkali scrubber 31 by an aqueous solution of sodium hydroxide supplied from a feed pipe 29, and were converted into an aqueous solution of sodium salts ($Na_2SO_4$, $NaNO_3$, etc). The solution was discharged through a discharge pipe 30. Since these aqueous solutions are non-radioactive, they can be processed by non-radioactive chemical waste liquor processing steps in the nuclear power station.

When the waste liquor obtained in this example was dried, the radioactive concentration of the resulting solid $Na_2SO_4$ and the like was below $10^{-7}$ μCi/g, which is the detection limit by a current precision measurement method, and the secondary waste such as $Na_2SO_4$ could be handled as the non-radioactive waste. This means also that the contamination removal coefficient in the low-temperature pyrolysis is at least $10^5$. Incidentally, the moisture contained in the waste resin was generated as vapor, and the vapor was condensed by a condenser 27 and was recovered as the water for re-use from the pipe 28. A considerable amount of exhaust gas after the treatment by the alkali scrubber 31 was discharged through a filter 32.

After the low-temperature pyrolysis was made in the course of about one hour in the reaction vessels 40, the remaining waste residue (consisting solely of the polymer backbone) was pyrolyzer at a high temperature of 600° C. by the heater 34 in the same vessels 40.

During this high-temperature pyrolysis, the air from an air pump 19 was continuously supplied into each reaction vessel 40 at a rate of 150 l/min through the valve 21. As a result, the average velocity in the reaction vessel became about 1 cm/sec. After the high-temperature pyrolysis for about 6 hours, the polymer backbone could be decomposed, and only the stable residue was left in an amount of about 0.5 kg in each reaction vessel 40. About 200 $m^3$ of carbon dioxide ($CO_2$), carbon monoxide (CO), hydrogen gas ($H_2$), hydrocarbon gas ($CH_4$) and the like were generated by the high-temperature pyrolysis, and these exhaust gases passed through the valve 35 and the filter 25 for the high-temperature decomposition, then entered a flare stack 26, whereby they were burnt and exhausted as $CO_2$ and $H_2O$ gases. The quantity of the radioactive substances contained in the exhaust gases and collected by the filter 25 was measured, but the radioactivity was below the detection limit. The contamination removal coefficient in the high-temperature pyrolysis was at least $10^4$. The quantity of the residue collected by the filter 25 was below 5 g, and the load to the filter was reduced extremely.

The residue after the high-temperature pyrolysis was hot-pressed by upper and lower presses 43 and 47 at a pressure of 40 kg/$cm^2$ (total pressure: 100 ton) while it was kept at the high-temperature pyrolysis point of 600° C. in the same reaction vessels 40. After the hot-press, the residue was turned into a disc-like molded article 50, moved downwards together with the piston **48*a* of the hydraulic cylinder 48 of the lower press 47, was discharged by the hydraulic cylinder 46, was charged in a drum 49** and was finally solidified by a solidifying agent such as cement or plastics. The undecomposed polymer backbone of the waste resin was decomposed by the high-temperature pyrolysis to be converted into a stable inorganic residue. Accordingly, it was extremely stable to store. The residue after the decomposition consisted primarily of silica ($SiO_2$) and a clad (mainly iron oxides) in the cooling water for the reactor, that attached to the ion exchange resin.

After the hot-pressing of the residue in the reaction vessel 40 was completed, the turn tables 38, 39 were rotated by 1/10 with a shaft 41 being the center, and the adjacent reaction vessel 40 containing only the residue after the high-temperature pyrolysis was moved to the position of the presses 43, 47 so that the residue was hot-pressed in the same way as described above. In this manner, the waste resin charged in the reaction vessel 40 was subjected to the two-stage pyrolysis, the remaining residue was sequentially hot-pressed and was sequentially charged in the drum. Though part of the residue attached to the inner wall surface of the reaction vessel 40, the remaining residue was scraped off by the pistons **44*a*, 48*a* of the cylinders 44, 48 when the upper and lower cylinders 44, 48 slid inside the reaction vessel 40**. Thus, all the residue could be converted into the molded article.

In accordance with this example, both low and high temperature pyrolysis and hot-press could be carried out in the same reaction vessel 40, and the volume reduction and inorganic conversion of the waste resin could be efficiently effected without permitting any residue to remain in the reaction vessel 40. Since the resulting molded article 50 had a sufficiently high strength, it could be easily handled without undergoing powdering or breakage. Furthermore, the molded article 50 had a density of as great as 0.9 g/$cm^3$ and exhibited a high volume reduction effect. In other words, when 100 kg of the used resin was processed, the resulting radioactive waste was only 5 kg of the residue, and its volume was about 5.5 l (about 1/30 of the original volume). Accordingly, the volume of the radioactive waste dropped below 1/5 in comparison with the conventional fluidized bed process and acid decomposition process.

In this example, the air was supplied as the oxidizing agent for the high-temperature pyrolysis, but oxygen can be also supplied. In such a case, if oxygen is supplied at the same feed speed as that of the air, the time necessary for the high-temperature pyrolysis can be reduced by maximum 1/5, but the possibility of explosion is induced.

Figure 13:
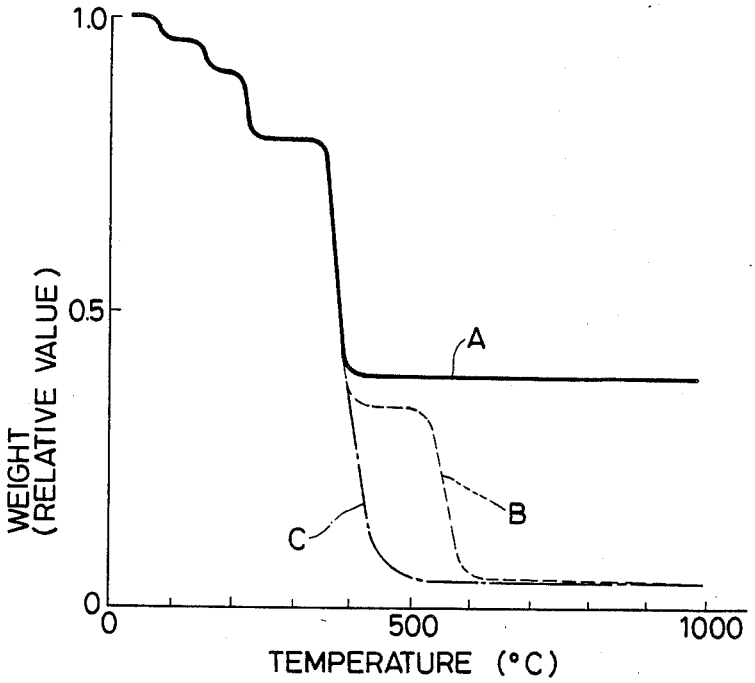
FIG. 13 is a diagram showing the effect of addition of an oxidizing agent.

FIG. 13 illustrates the effect of the addition an oxidizing agent. In the drawing, in the case of the nitrogen atmosphere without the addition of the oxidizing agent in the high-temperature pyrolysis of 350° C. or above (represented by curve A), about 25 to 30% of residue remained even if heating was made to 1,000° C. On the other hand, when steam was added as the oxidizing agent (represented by curve B), the residue could be drastically reduced at 600° C. or above, and dropped below several percents at 700° C. or above. When the air was used as the oxidizing agent (represented by curve C), the weight dropped drastically at 400° C. or above, and the residue dropped below several percents at 500° C. or above. In other words, the high-temperature pyrolysis in the reaction vessel 40 is preferably carried out at a temperature of above 700° C. if the inert gas such as nitrogen gas is used, and at a temperature of above 500° C. if the pyrolysis is made in an atmosphere of air. In order to minimize the residue, the oxidizing agent such as steam or air is preferably added. This makes it possible to reduce the volume of the waste resin to about 1/10.

In the example described above, the low and high temperature pyrolysis as well as hot-pressing were effected in the same reaction vessel, but they can be, practiced in separate vessels. In such a case, the operation procedures become more complicated. The vessel in which hot-pressing is made must be sufficiently strong to withstand the pressure.

The example described above is related to an application to the boiling water reactor, but the present invention can also be applied to the processing of the used ion exchange resin generated in waste liquor purification systems of installations handling the radioactive substances, such as a reactor purification system, a primary coolant purification system of a pressurized water reactor, and so forth.

In the example described above, the exhaust gas generated during the low-temperature pyrolysis was processed by use of the alkali scrubber 31, but the same effect can be obtained by dry processing of the exhaust gas using active carbon, MnO, or the like.

In the example described above, the temperatures in the low and high temperature pyrolysis were controlled by the heater 34, the thermometer 36 and the controller 37, and the operation of the valves 23 and 35 for the two exhaust gas systems were also controlled by the controller 37.

Before pyrolyzing the ion exchange resin, the moisture contained in the resin may be removed by heating or centrifugal means before the resin is charged in the reaction vessel 40 or by heating the resin to 110° to 120° C. by the heater 34 after the resin is charged in the reaction vessel 40.

EXAMPLE 2

Example 1 pertains to the example of the volume reduction and inorganic conversion of the used ion exchange resin containing only the adsorbed corrosive products (Co, Mn, Fe, etc) as the radioactive substances. An experiment of processing a used ion exchange resin containing adsorbed nuclear fission products (Cs, Sr, etc) was carried out to cope with the possibility of breakage of nuclear fuel rods.

100 kg of used ion exchange resins containing $10^{-2}$ $\mu$Ci/g (dry weight) of the adsorbed corrosive products and the nuclear fission products, respectively, were processed in the same way as in Example 1. As a result, exactly the same result could be obtained as in Example 1 except the following point. The difference was that among the nuclear fission products generated by the high-temperature pyrolysis, the radioactive substances whose oxides had a low melting point, such as Cs and Rb, spattered and were collected by the filter 25 for the high-temperature pyrolysis. For this reason, the contamination removal coefficient in the high-temperature pyrolysis became about $10^3$, but the load to the filter was by far smaller than that in the conventional fluidized bed process (contamination coefficient: 10~20).

EXAMPLE 3

The low-temperature pyrolysis was effected at 350° C. in Example 1, but it can be carried out at a temperature equal to the high-temperature pyrolysis, for example, at 600° C. As can be seen clearly from FIGS. 3 or 4, only the ion exchange group can be decomposed and removed even if pyrolysis is effected at a temperature of 350° C. or above without feeding oxygen. For example, pyrolysis was first made at 600° C. without feeding oxygen to remove the ion exchange group, and the polymer backbone was then pyrolyzed at the same temperature of 600° C. by feeding oxygen. In such a case, the apparatus could be simplified, but if the used resin had adsorbed those radioactive substances which were easily spattered, such as Cs and Rb, these radioactive substances would be incorporated in the secondary waste such as $Na_2SO_4$ that was generated as a result of the exhaust gas processing of sulfur and nitrogen compounds (SOx, $H_2S$, NOx, $NH_3$, etc), so that the amount of the radioactive waste became about 5 times that of Example 1. Accordingly, this example exhibited a remarkable effect in processing the used resin which had adsorbed only the corrosive products such as Co or Mn.

EXAMPLE 4

Only the residue was hot-pressed in Example 1, but it is also effective to charge in advance a vitrifying agent corresponding to 10 to 40 wt % of the residue generated finally, and then to carry out hot-pressing after the resin is pyrolyzed in two stages. In other words, the vitrifying agent is in a fused state during the hot-pressing so that it functions as a binder and the pressure necessary for the hot-pressing needs be only about ½ of the pressure (40 kg/cm$^2$) in Example 1. In addition, when the molded article 50 is finally solidified in the waste storage vessel such as a drum 49, the vitrifying agent has high affinity with the molded article and with the solidifying agent, so that the durability of the solidified waste can be improved. The radioactive substances that are easily spattered, such as Cs and Rb, are entrapped in the network structure of the glass during the high-temperature pyrolysis and are solidified and fixed. For this reason, the radioactive spattering ratio can be improved extremely remarkably. An ordinary glass frit consisting principally of silica ($SiO_2$) may be used as the vitrifying agent. Since the glass frit is fused at 500° to 600° C., it functions as the binder and also entraps Cs, thus preventing spattering of Cs. It is also preferred to add about 20 wt % of boron oxide ($B_2O_3$) during the pyrolytic reaction in order to carry out efficiently the fusing and solidification of the glass. In this case, the vitrifying agent acts effectively only during the high-temperature pyrolysis, but from the viewpoint of the operation procedures, the vitrifying agent is preferably charged in the reaction vessel 40 together with the waste resin before carrying out the low-temperature pyrolysis. In FIG. 10, reference numeral 33 represents a glass frit feed pipe, and an arbitrary amount of the glass frit is fed to the reaction vessel 40 by the operation of the valve 20.

EFFECTS OF THE INVENTION

In the present invention, the used ion exchange resin is pyrolyzed by the two-stage pyrolysis at low and high temperatures, and the resulting residue is hot-pressed. Accordingly, the present invention can drastically reduce the volume, and can selectively process the exhaust gases generated during the pyrolysis.

We claim:

1. A method of processing radioactive waste resin by pyrolyzing radioactive waste ion exchange resin generated in a nuclear plant in a reaction vessel, comprising pyrolyzing said ion exchange resin without the presence of oxygen at low temperatures between 120° C. and 350° C. in the same reaction vessel, separating the resulting decomposition gas, then pyrolyzing said ion exchange resin in the presence of oxygen at high temperatures between 350° C. and 600° C. in the same reaction vessel, separating the resulting decomposition gas, and thereafter hot-pressing the residue of said ion exchange resin into a molded article in the same reaction vessel.

2. A method of processing radioactive waste resin as defined in claim 1, wherein the pyrolyzing at a high temperature is effected while supplying an oxidizing agent.

3. A method of processing radioactive waste resin as defined in claim 2, wherein said oxidizing agent is air.

4. A method of processing radioactive waste resin as defined in claim 3, wherein the average velocity of the air supplied from outside is up to 1.5 cm/s within the reaction vessel.

5. A method of processing radioactive waste resin as defined in claim 1, wherein said hot-pressing is effected while at least part of said residue is being fused or softened by the pyrolysis at high temperatures between 350° C. and 600° C.

6. A method of processing radioactive waste resin as defined in claim 5, wherein said hot-pressing is effected immediately after the pyrolysis at a high temperature while the temperature is being kept as such.

7. A method of processing radioactive waste resin as defined in claim 1, wherein the pyrolysis at a high temperature is effected in the presence of a vitrifying agent which adsorbs volatile radioactive substances.

8. A method of processing radioactive waste resin as defined in claim 7, wherein said vitrifying agent is added before the pyrolysis at a low temperature is effected.

9. A method of processing radioactive waste resin as defined in claim 7, wherein said vitrifying agent is glass frit comprising silica as its principal component.

10. A method of processing radioactive ion exchange resins into stable and safely storable forms comprising the steps of:

a. introducing a quantity of radioactive ion exchange resin into a sealed reaction vessel;

b. heating the radioactive ion exchange resin in the sealed reaction vessel without the presence of oxygen to a temperature sufficient to remove the ion exchange group from the radioactive ion exchange resin but insufficient to decompose the polymer backbone of the radioactive ion exchange resin and insufficient to initiate the spattering of the radioactive material;

c. removing the gases produced by the heating of the radioactive ion exchange resin from the reaction vessel and introducing said gases to an exhaust gas processing apparatus;

d. inserting an oxygen-containing gas into the reaction vessel at a velocity insufficient to initiate the spattering of the radioactive material;

e. heating the remaining radioactive resin and the oxygen-containing gas in the reaction vessel to a temperature sufficient to decompose the polymer backbone of the remaining radioactive resin;

f. removing the gases produced by the heating of the radioactive resin and the oxygen containing gas from the reaction vessel;

g. hot-pressing the remaining radioactive residue while within the reaction vessel into a molded article at a temperature substantially similar to that of the heating of the radioactive resin; and, h. removing the molded article containing the radioactive residue from the reaction vessel.

11. A method of processing radioactive ion exchange resin as defined in claim 10, wherein the heating of the radioactive ion exchange resin in the reaction vessel without the pressure of oxygen occurs at a temperature of 350° C. or below.

12. A method of processing radioactive ion exchange resin as defined in claim 10, wherein the heating of the radioactive resin and the oxygen-containing gas in the reaction vessel occurs at a temperature of 350° C. or above.

13. A method of processing radioactive ion exchange resin as defined in claims 10, wherein the inserting of an oxygen-containing gas into the reaction vessel is at a velocity of 1.5 cm/s or below.

14. A method of processing radioactive ion exchange resin as defined in claim 10, wherein the gases produced by the heating of the radioactive ion exchange resin in the reaction vessel without the pressure of oxygen are sulfur and nitrogen oompounds.

15. a method of processing radioactive ion exchange resin as defined in claim 14, wherein the gases of the sulfur and nitrogen compounds are $SO_x$, $H_2S$, $NO_x$ and $NH_4$.

16. A method of processing radioactive ion exchange resin as defined in claim 10, wherein the exhaust gas processing apparatus is an alkali scrubber which converts the gases produced by the heating of the radioactive ion exchange resin in the reaction vessel without the presence of oxygen, into aqueous solutions of sodium salts.

17. A method of processing radioactive ion exchange resin as defined in claim 10, wherein the gases produced by the heating of the radioactive resin and the oxygen-containing gas in the reaction vessel are $CO_2$, CO, $H_2$ and $CH_4$.

18. A method of processing radioactive ion exchange resin as defined in claim 17, wherein the $CO_2$, CO, $H_2$ and $CH_4$ gases are introduced to a flame stack and burnt producing $CO_2$ and $H_2O$ gases.

19. A method of processing radioactive ion exchange resin as defined in claim 11, wherein the heating of the radioactive ion exchange resin in the reaction vessel without the presence of oxygen occurs at a temperature between 120° C. and 350° C.

20. A method of processing radioactive ion exchange resin as defined in claim 19, wherein the heating of the radioactive ion exchange resin in the reaction vessel without the presence of oxygen occurs at about 300° C.

21. A method of processing radioactive ion exchange resin as defined in claim 12, wherein the heating of the radioactive ion exchange resin and the oxygen-containing gas in the reaction vessel occurs at a temperature of about 600° C.

22. A method of processing radioactive ion exchange resin as defined in claim 10, wherein said hot-pressing occurs immediately after the heating of the remaining radioactive resin and the oxygen-containing gas in the reaction vessel to a temperature sufficient to decompose the polymer backbone of the remaining radioactive resin, which the temperature of the reaction vessel is maintained as such.

23. A method of processing radioactive ion exchange resin as defined in claim 10, wherein the heating of the remaining radioactive resin and the oxygen-containing gas in the reaction vessel to a temperature sufficient to decompose the polymer backbone of the remaining radioactive resin occurs in the presence of a vitrifying agent which absorbs volatile radioactive substances.

24. A method of processing radioactive waste resin as defined in claim 23, wherein said vitrifying agent is added prior to heating.

* * * * *